United States Patent [19]

Barnes et al.

[11] 4,135,447

[45] Jan. 23, 1979

[54] MACHINE FOR PRINTING MEASURING TAPE

[75] Inventors: Carl K. Barnes; John O. Barnes, both of Suffield, Conn.

[73] Assignee: Jack Barnes Engineering, Inc., Enfield, Conn.

[21] Appl. No.: 818,156

[22] Filed: Jul. 22, 1977

Related U.S. Application Data

[63] Continuation-in-part of Ser. No. 687,107, May 17, 1976, Pat. No. 4,051,774.

[51] Int. Cl.[2] ..... B41F 17/00; B41F 17/10

[52] U.S. Cl. ..... 101/177; 101/37; 101/74; 101/178; 101/217; 101/416 A

[58] Field of Search ..... 101/35-37, 101/73-75, 212, 216-219, 177, 178, 416 A

[56] References Cited

U.S. PATENT DOCUMENTS

| | | | |
|---|---|---|---|
| 1,100,284 | 6/1914 | Bohnengel | 101/74 |
| 2,066,179 | 12/1936 | Keller | 101/219 |
| 3,162,117 | 12/1964 | Young | 101/74 X |
| 3,203,346 | 8/1965 | Norton et al. | 101/217 |
| 3,329,088 | 7/1967 | Rockefeller, Jr. | 101/212 X |
| 3,552,308 | 1/1971 | Minehart | 101/74 X |
| 3,788,213 | 1/1974 | Brown, et al. | 101/75 X |

*Primary Examiner*—Clifford D. Crowder
*Attorney, Agent, or Firm*—Ross, Ross & Flavin

[57] ABSTRACT

A machine for printing English or metric or combination English metric measuring tapes of long or short length comprising a plurality of self-contained modules for controlling, feeding, printing, stabilizing, and taking up the printed tape, the printing module being adapted to print: (1) long English tapes in two colors of 50 or 100 feet in length using a blanket roll and a printing band; and (2) metric tapes or short English tapes or combination English metric tapes in two colors using a pair of printing bands.

3 Claims, 30 Drawing Figures

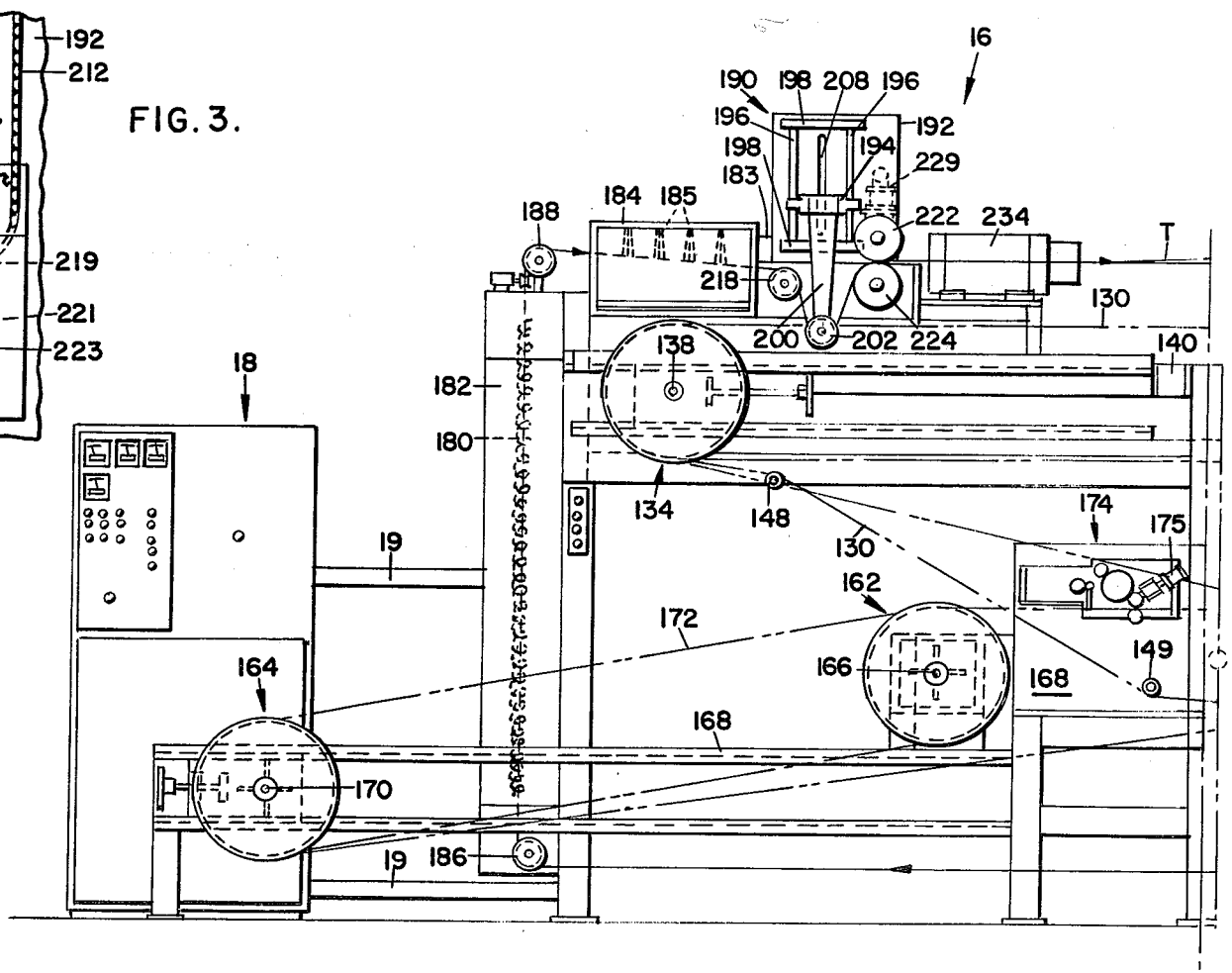
FIG. 1B.
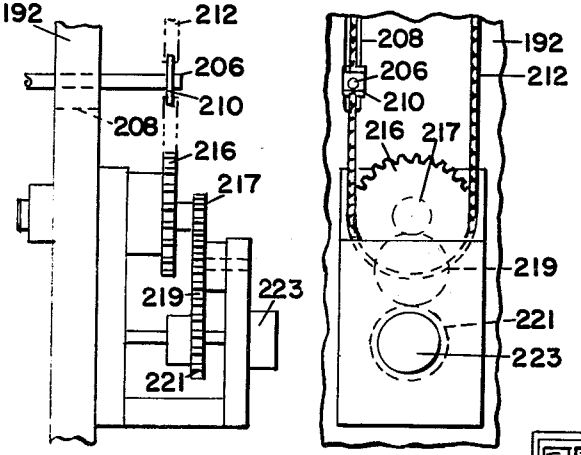
FIG. 3.
FIG. 2.
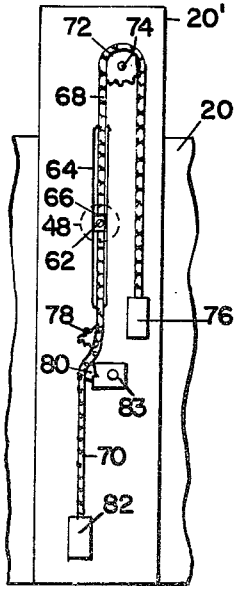
FIG. 4.

TAKE-UP REEL MOTOR CONTROL

PRINTER MOTOR CONTROL

STABILIZER MOTOR CONTROL

MACHINE FOR PRINTING MEASURING TAPE

This is a continuation-in-part of our co-pending application Ser. No. 687,107 filed May 17, 1976, now U.S. Pat. No. 4,051,774.

A primary object of the invention is to provide an extremely accurate high speed self-contained unit which is adapted to print graduated long or short English or metric or combination English/metric tapes in two colors.

Another object is to provide such a machine which is compact and utilizes a minimum of space.

In the drawings:

FIGS. 1A and 1B together comprise a broken, front elevational view of a tape printing machine embodying the invention;

FIG. 2 is an enlarged, fragmentary, side elevational view of a portion of the second dancer subassembly;

FIG. 3 is a rear elevational view of the second dancer subassembly of FIG. 2;

FIG. 4 is a fragmentary, rear elevational view of the first dancer subassembly;

MACHINE MODULAR CONCEPT

Figure 1A:
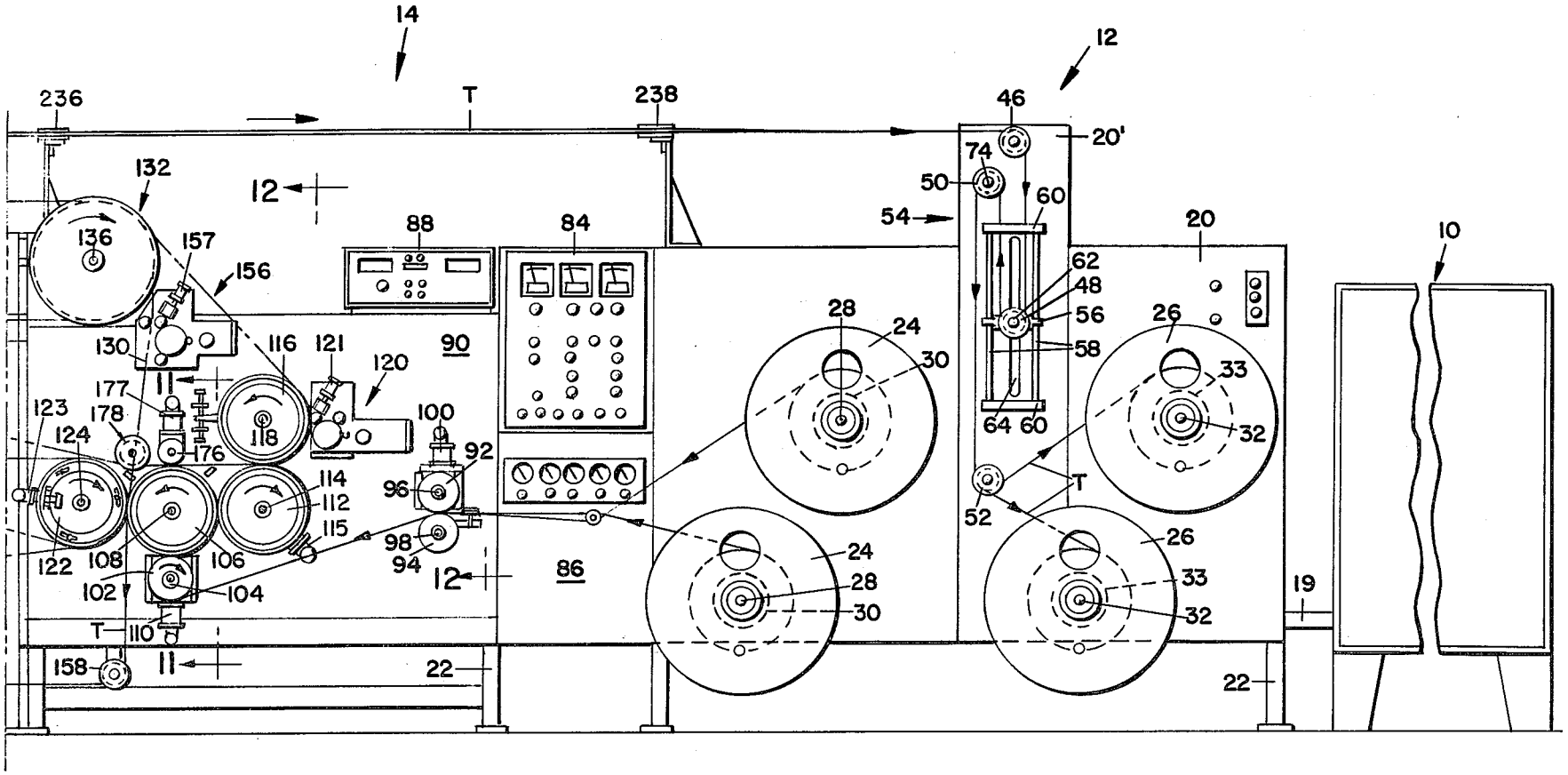

The machine of the invention utilizes a modular concept wherein a plurality of self-contained modules are quickly connected or disconnected, thereby permitting easy machine assembly and disassembly, the modules comprising:

a main electrical panel module 10;
a tape supply and tape take up module 12;
a printing module 14;
a stabilizing module 16; and
an induction generator and control module 18.

Suitable coaxial connectors 19 link the several modules.

MAIN ELECTRICAL PANEL MODULE 10

The main electrical panel module 10 is a self-contained unit which houses all of the drive control units, main disconnect, and main control transformers and relays. All motor controls are complete solid state units which control the take-up reel drive motor, printer drive motor, and stabilizer drive motor, all to be described.

TAPE SUPPLY AND TAPE TAKE-UP MODULE 12

Module 12 is disposed adjacent module 10 and includes an upright wall 20 supported upwardly of the floor by a supporting framework 22 and having pairs of tape supply reels 24 and tape take-up reels 26 journalled therein. Dual supply and take-up reels are employed to facilitate switching when the reels are filled or emptied, as the case may be.

Tape supply reels 24 are mounted on shafts 28 which extend freely through wall 20 and are journalled at their inner ends in framework 22. Each shaft 28 passes through a pneumatic brake 30 of commercially available type mounted on the rear face of wall 20, the brakes being individually controlled for controlling the speed of rotation of the shafts and, hence, the speed with which blank tape carried by the supply reels 24 is paid out. The brakes maintain a constant slight drag on the shafts so that the reels do not pick up undesired rotative speed as the amount of tape thereon changes.

Tape take-up reels 26 are mounted on shafts 32 which extend freely through wall 20 and pass through pneumatic clutches 33 of commercially available type and are journalled at their inner ends in framework 22. The clutches are engaged or disengaged depending upon which reel is in use. When a clutch is disengaged its shaft 32 will not turn.

Figure 10:
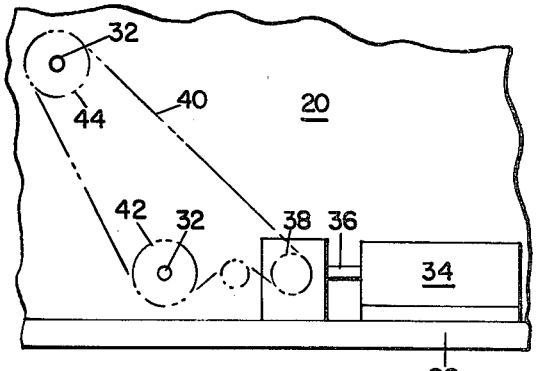
FIG. 10 is a somewhat schematic fragmentary, elevational view of the take-up reel drive means.

The take-up reel drive means is shown in FIG. 10 and includes a take-up reel drive motor 34 mounted on supporting framework 22 and having an output shaft 36 operatively connected to a drive sprocket 38. A chain 40 is entrained around drive sprocket 38 and around a pair of sprockets 42 and 44 fixed to the lower and upper take-up reel shafts 32 respectively, whereby rotation of drive sprocket 38 effects rotation of the shafts 32 to wind printed tape T or T', (see FIGS. 8 and 8A), onto take-up reels 26.

Printed tape T or T' being fed to the take-up reels 26 passes around a quartet of rolls 46, 48, 50 and 52 mounted on wall 20 and on an extension 20' thereof adjacent the take-up reels.

Roll 48 is part of a first dancer subassembly 54 which includes a slide member 56 slideably mounted on a pair of horizontally spaced, upright slide rods 58 which extend between vertically spaced brackets 60 on wall 20 and extension 20'.

Roll 48 is fixed to a shaft 62 which is journalled in and extends rearwardly from slide member 56 through a vertical slot 64 in wall 20 and has a connector 66 fixed to its inner end, (see FIG. 4).

Connector 66 has a first chain 68 fixed to one end thereof and a second chain 70 fixed to the other end thereof.

First chain 68 extends upwardly from the connector and around a sprocket 72 fixed to a shaft 74 extending rearwardly from wall extension 20', shaft 74 having roll 50 fixed thereto on the opposite side of the wall extension. First chain 68 depends from sprocket 72 and has a weight 76 fixed to its lower free end.

Second chain 70 depends from connector 66 and passes between a pair of sprockets 78 and 80 journalled in the rear face of wall 20, the second chain having a weight 82 fixed to its lower end.

A gear train, not shown, connects sprocket 80 to a potentiometer 83 which is connected to take-up reel drive motor 34, the potentiometer signalling the drive motor to speed up or slow down as appropriate.

Rotative movement is imparted to sprocket 80 by vertical movement of chain 70 as roll 48 moves vertically. Movement of chain 70 in one direction will cause the potentiometer to signal take-up reel drive motor 34 to slow down. Movement of the chain in an opposite direction will cause the potentiometer to signal the take-up reel drive motor to speed up.

By means of the first dancer subassembly, tension on the printed tape remains constant regardless of the amount of tape on the take-up reels 26.

Also included in the tape supply and take-up module 12 are an operator's electrical control panel 84, a pneumatic control panel 86 and a solid state logic control unit 88, all to be described hereinafter.

In summary, the tape supply and take-up module 12 contains the two tape supply reels 24 which are controlled by the pneumatic brakes 30 which are each individually controlled. Also contained in this unit are the tape take-up reels 26 which are controlled by the individual pneumatic clutches 33, the reels being driven by one common drive motor 34.

PRINTING MODULE 14

Printing module 14 is disposed adjacent tape supply and take-up module 12 and includes an upright wall 90 supported upwardly of the floor by supporting framework 22, wall 90 being aligned with wall 20 of module 12.

Blank tape from supply reels 24 passes between a pair of upper and lower, vertically aligned, feed or metering rolls 92 and 94 respectively, roll 92 being fixed to a shaft 96 and roll 94 being fixed to a shaft 98, both shafts 96 and 98 being journalled in wall 90.

A solenoid controlled air cylinder 100 mounted on wall 90 above upper roll 92 is linked to the shaft 96 of roll 92 whereby the pressure of the rolls bearing on the tape may be varied.

The tape passes from the nip of the rolls 92 and 94 to a pressure roll 102 horizontally spaced therefrom and fixed to a shaft 104 journalled in wall 90, pressure roll 102 being in running engagement with a bull roll 106 fixed to a shaft 108 also journalled in wall 90 and vertically aligned with shaft 104.

A solenoid controlled air cylinder 110 mounted on wall 90 below pressure roll 102 is linked to the shaft 104 of the pressure roll whereby the pressure of that roll bearing on bull roll 106 may be varied.

In a first mode of machine operation, for printing long English tapes, a blanket roll 112 is in running engagement with bull roll 106, the blanket roll being fixed to a shaft 114 horizontally aligned with bull roll shaft 108 and journalled in wall 90.

A solenoid controlled air cylinder 115 mounted on wall 90 below blanket roll 112 is linked to the shaft 114 of the blanket roll whereby the pressure of that roll bearing on bull roll 106 may be varied.

In said first mode of machine operation, blanket roll 112 is in running relation with a master die roll 116 fixed to a shaft 118 vertically aligned with blanket roll shaft 114 and journalled in wall 90.

A first color inker 120 is in running engagement with master die roll 116 and applies the first color ink to a printing die, not shown, carried on the periphery of the master die roll. The printing die, in the form of inch graduations, reproduces impressions of the graduations on the periphery of blanket roll 112 and these impressions are, in turn, transferred onto the tape blank as it passes through the nip between the blanket roll and bull roll 106.

A solenoid controlled air cylinder 121 mounted on wall 90 above first color inker 120 is linked to the shaft of one of the rolls thereof, whereby the pressure exerted by that roll on the printing die may be varied.

The means for applying indicia of a second color includes a pin roll 122 fixed to a shaft 124 journalled in wall 90, shaft 124 being horizontally spaced from and disposed slightly above the plane of bull roll shaft 108.

A solenoid controlled air cylinder 123 mounted on wall 90 adjacent pin roll 122 is linked to the shaft 124 thereof, whereby the pressure exerted by the pin roll on bull roll 106 may be varied.

Figure 13:
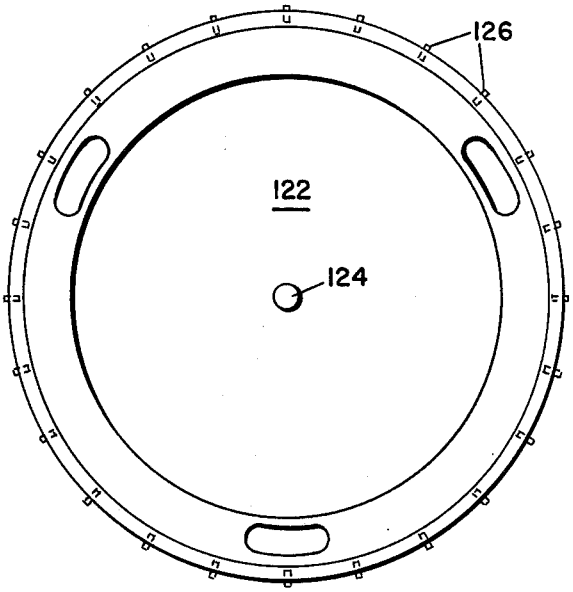
FIG. 13 is an enlarged front elevational view of the pin roll.
Figure 14:
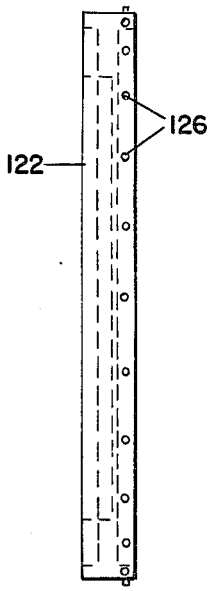
FIG. 14 is a side elevational view of the pin roll of FIG. 13.

As best seen in FIGS. 13 and 14, pin roll 122 carries a plurality of equi-spaced, radially-arranged pins 126 which extend outwardly from its periphery. Pins 126 are engageable in equi-spaced openings 128 in a flexible printing band 130, (see FIG. 9), entrained around the pin roll and around a pair of spaced, first and second grooved roll assemblies 132 and 134 respectively disposed in a plane vertically above that of the pin roll.

First grooved roll assembly 132 is mounted on a shaft 136 journalled in a first auxiliary framework 137 (see FIG. 12), provided on supporting framework 22 and disposed rearwardly of wall 90. Shaft 136 is in substantial vertical alignment with pin roll shaft 124.

Second grooved roll assembly 134 is mounted on a shaft 138 journalled in a second auxiliary framework 140 which is disposed in alignment with and adjacent wall 90, shaft 138 being horizontally spaced from and aligned with first grooved roll assembly shaft 136.

Figure 15:
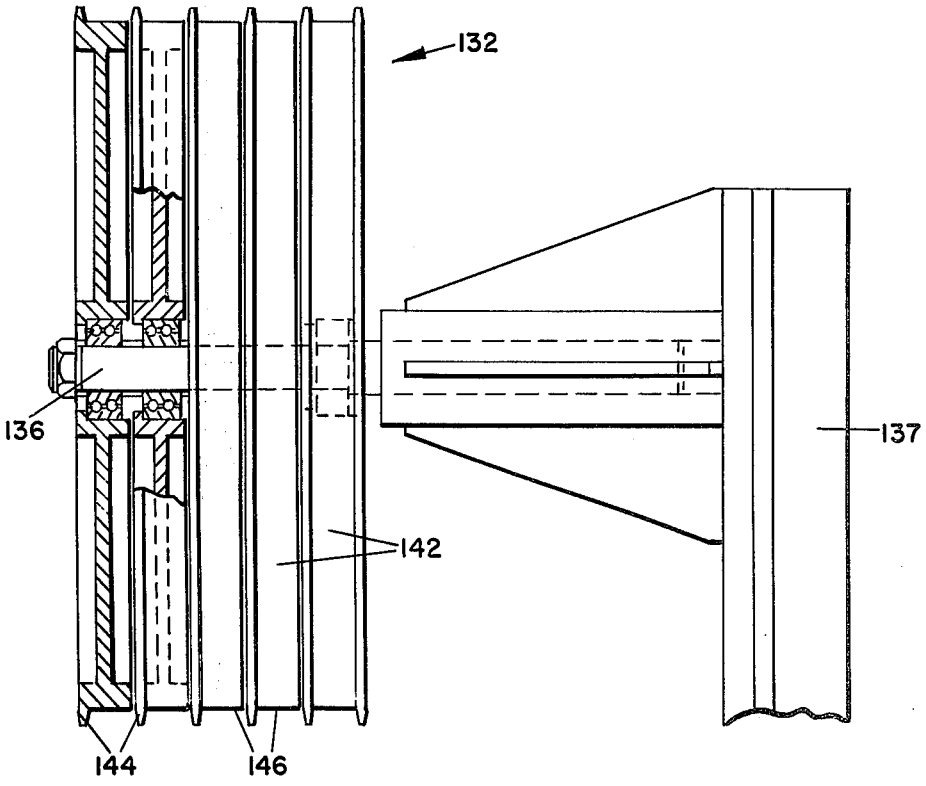
FIG. 15 is an enlarged, fragmentary, side elevational view of one of the grooved roll assemblies, with parts broken away.

The first and second grooved roll assemblies being identical, only one thereof will be described. As seen in FIG. 15, which illustrates first grooved roll assembly 132, a plurality of rolls 142 are rotatably mounted in side by side arrangement on shaft 136, each roll having a peripheral rim 144 at one edge thereof for defining a plurality of spaced grooves 146, the innermost roll 142 having a pair of such rims for defining the groove.

The printing band leading from pin roll 122 is helically turned at a pair of turning rollers 148 and 149 on auxiliary framework 140 and then passes back and forth in grooves 146 from one grooved roll assembly to the other before returning to the pin roll. In this manner, a one hundred foot band can be accommodated in a relatively small space.

Figure 8:
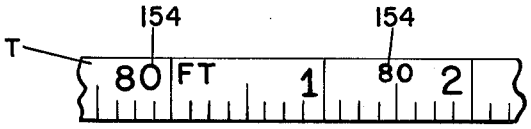
FIGS. 8 and 8A are enlarged, fragmentary, front elevational views of portions of steel tapes of the types printed by the machine of the invention.
Figure 9:
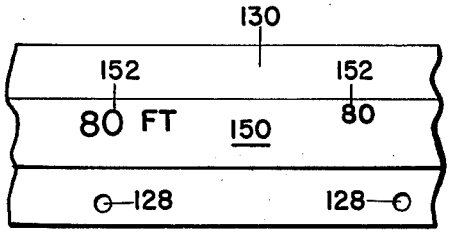
FIG. 9 is an enlarged, fragmentary, top plan view of the perforated printing band for printing such as foot or metric designations and other desired indicia on the tape.

As seen in FIGS. 9 and 8, printing band 130 carries a rubber printing die 150 having characters 152 thereon for printing foot graduations 154 either of fifty foot length or one hundred foot length on tape T.

Printing die 150 receives ink from a second color inker 156 disposed on wall 90 between first grooved roll assembly 132 and pin roll 122 and this data is transferred to the tape blank at bull roll 106 in the form of the foot graduations 154 printed in red ink.

A solenoid controlled air cylinder 157 mounted on wall 90 above second color inker 156 is linked to the shaft of one of the rolls thereof whereby the pressure exerted by that roll on the printing die may be varied.

Printed tape T passes from the nip between pin roll 122 and bull roll 106 around an idler roll 158 journalled in supporting framework 22 below the pin roll to stabilizing module 16.

Figure 16:
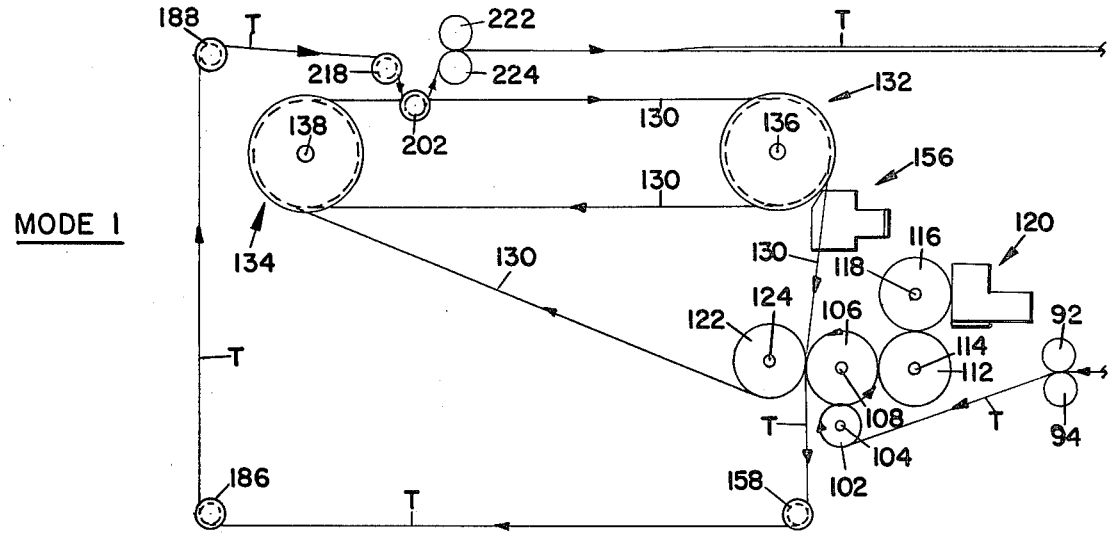
FIGS. 16–18 are schematic showings of the roll arrangements in three modes of machine operation.

The first mode of machine operation just described is shown schematically in FIG. 16, it being understood that this mode is utilized for printing long English tapes of fifty or one hundred foot lengths.

Figure 17:
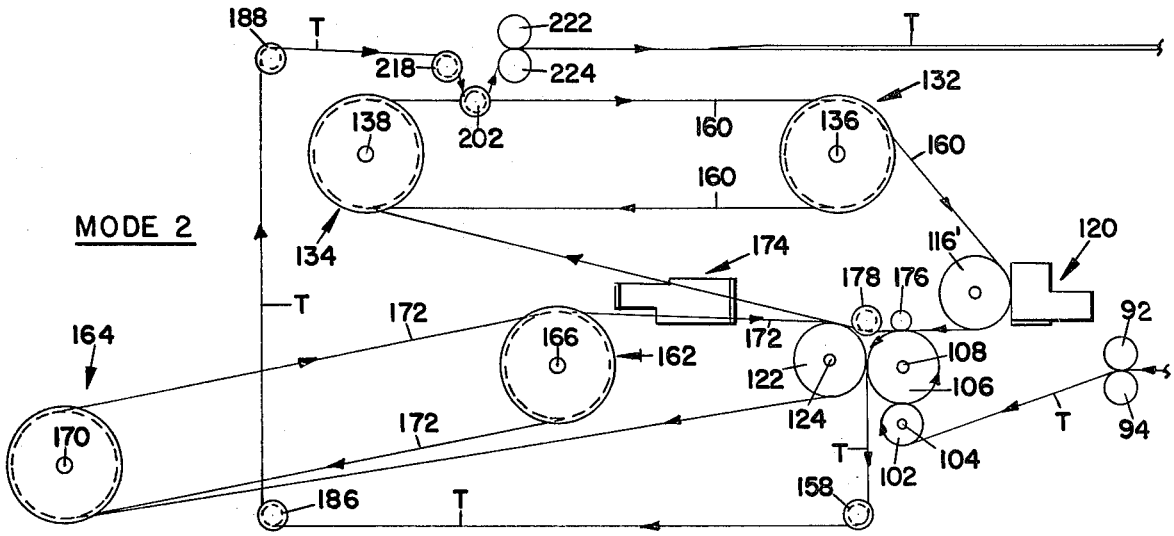

In a second mode of machine operation, shown schematically in FIG. 17, long metric tapes of 15, 20, 25 or 30 meters are printed.

In the second mode of machine operation, master die roll 116 is replaced by a pin roll 116', similar to pin roll 122, and blanket roll 112 is not utilized.

A printing band 160, similar to printing band 130, is entrained around pin roll 116' and around first and second grooved roll assemblies 132 and 134, the printing band 160 carrying a printing die, not shown, similar to printing die 150.

Pin roll 116' is in running relation with first color inker 120 for printing centimetric graduations on the tape in black ink.

In said second mode of machine operation, pin roll 122 is used in the second color system as in the first mode of operation. However, it is used in conjunction with a second set of horizontally-spaced grooved roll assemblies 162 and 164 similar to grooved roll assemblies 132 and 134.

In this instance, grooved roll assembly 162 is mounted on a shaft 166, disposed adjacent one end of a sub-framework 168, see FIG. 1B, positioned below auxiliary framework 140, while grooved roll assembly 164 is mounted on a shaft 170 disposed adjacent the opposite end of sub-framework 168.

A printing band 172, similar to printing bands 130 and 160, is entrained around pin roll 122 and around grooved roll assemblies 162 and 164, the printing band carrying a printing die, not shown, similar to printing die 150.

In said second mode of machine operation, second color inker 156 is not utilized, a supplemental second color inker 174 being used in lieu thereof for printing metric graduations in red ink. Supplemental second color inker 174 is disposed on sub-framework 168 between grooved roll assembly 162 and pin roll 122 in running relationship with printing band 172.

A solenoid controlled air cylinder 175 mounted on subframework 168 above supplemental second color inker 174 is linked to the shaft of one of the rolls thereof, whereby the pressure exerted by that roll on printing band 172 may be varied.

Printing takes place at bull roll 106, and the printed tape T passes from the bull roll to idler roll 158 and around the idler roll to stabilizing module 16.

In said second mode of machine operation, a band pressure roll 176 is aligned with and disposed above bull roll 106 and bears on the upper surface of printing band 160, the printing band passing between the pressure roll and bull roll and under an idler roll 178 to grooved roll assembly 134.

A solenoid controlled air cylinder 177 mounted on wall 90 above band pressure roll 176 is linked to the shaft thereof, whereby the pressure exerted by the band pressure roll on the band may be varied.

Figure 8A:
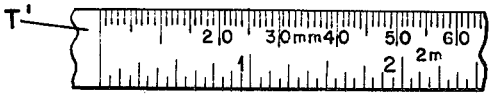
Figure 18:
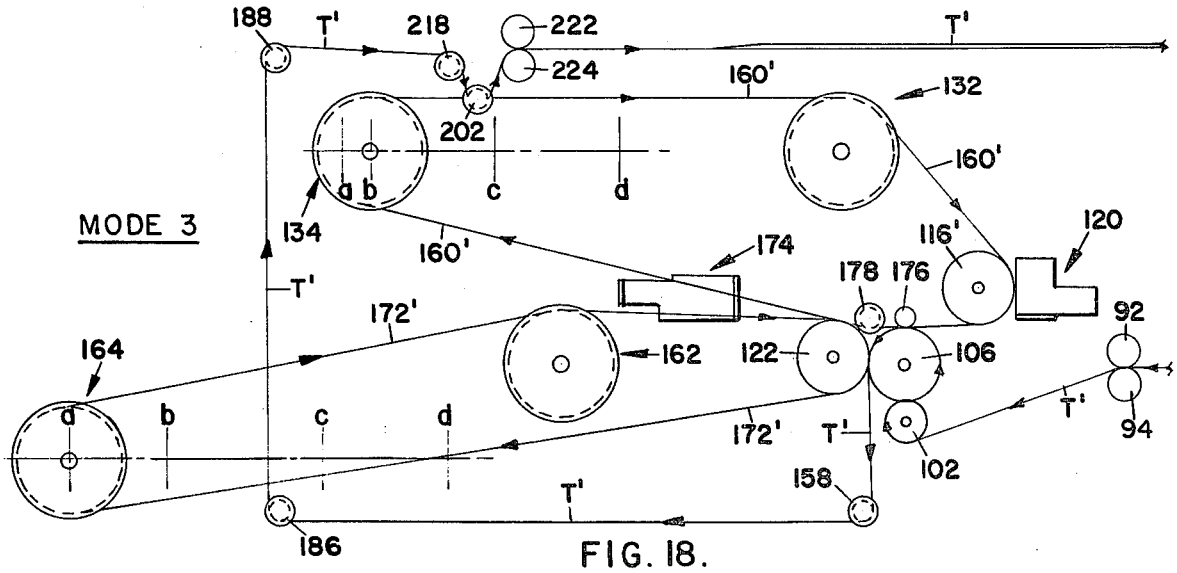

In a third mode of machine operation, shown schematically in FIG. 18, short metric tapes and/or English tapes and/or metric/English tapes T' of the type shown in FIG. 8A of 16, 20 or 25 feet may be printed.

This mode is the same as the second mode of machine operation, except that a first color printing band 160' is only wrapped once around grooved roll assemblies 132 and 134, while a second color printing band 172' is only wrapped once around grooved roll assemblies 162 and 164.

Two sets of dies can be used to produce shorter tapes, such as two eight foot lengths on a sixteen foot band, two ten foot lengths on a twenty foot band and two twelve foot lengths on a twenty-five foot band.

In said third mode of operation, the grooved roll assemblies 134 and 164 are positioned relative to their respective supporting frameworks at the positions a, b, c or d as indicated in FIG. 18, depending upon the length of tape being printed.

In all modes of machine operation, the printed tape T or T' passes from idler roll 158 to stabilizing module 16 for fixing.

STABILIZING MODULE 16

Stabilizing module 16 includes: a vertically-disposed induction heating coil 180 disposed in a housing 182 fixed to one end of auxiliary framework 140; a horizontally-disposed cooling water chill tank 184 supported on the upper surface of auxiliary framework 140 and having a plurality of spray nozzles 185 therein, and an air blast unit 183 supported on auxiliary framework 140 adjacent chill tank 184.

Printed tape T or T' passes from idler roll 158, around an idler roll 186 on auxiliary framework 140 below housing 182 and upwardly through induction heating coil 180.

As the tape exits from coil 180 and housing 182, it passes around an idler roll 188 disposed on the upper end of the housing and through water tank 184 to a second dancer subassembly 190 disposed adjacent water tank 184 and air blast unit 183 on the upper surface of auxiliary framework 140.

The vertical disposition of heating coil 180 permits of much smaller machine length than would a horizontal disposition and also facilitates restringing of the tape when breakage occurs.

The spray nozzles 185 give an even amount of spray over the entire length of tape passing through tank 184, while the air blast unit 183 removes any water remaining on the tape.

Second dancer subassembly 190, best seen in FIGS. 2, 3, 6 and 7, is mounted on a plate 192 which extends upwardly from auxiliary framework 140 and includes a slide member 194 slideably mounted on a pair of horizontally spaced, upright slide rods 196 which extend between vertically spaced brackets 198 on plate 192.

A finger-like roll support 200 is fixed to and depends from slide member 194 and carries a dancer roll 202 adjacent its lower end, the roll being fixed to a shaft 204 journalled in the roll support.

A slide rod 206 is fixed to slide member 194 and extends horizontally rearwardly therefrom through a vertical slot 208 in plate 192, the slide rod having a connector 210 fixed to its inner end (see FIG. 3), and the connector having the ends of a chain 212 fixed thereto.

Chain 212 is entrained around a pair of vertically spaced upper and lower sprockets 214 and 216 respectively, mounted for rotation relative to the rear face of plate 192.

A gear train comprising a trio of meshing gears 217, 219 and 221, connects sprocket 216 to a potentiometer 223, for purposes to appear.

Tape emerging from air blast unit 183 passes over an idler roll 218 fixed to a shaft 220 journalled in plate 192, around the lower portion of dancer roll 202 to the nip between a pair of vertically aligned upper and lower feed drive rolls 222 and 224 respectively.

Upper and lower feed drive rolls 222 and 224 respectively, are fixed to vertically aligned upper and lower shafts 226 and 228 respectively journalled in plate 192.

A solenoid controlled air cylinder 229 mounted on the rear of plate 192 above upper feed drive roll 222 is linked to the shaft 226 thereof, whereby pressure of that roll on the tape may be varied.

Lower shaft 228 extends rearwardly from plate 192 to a reduction gear unit 230 where it is linked to the drive shaft 232 of a stabilizer drive motor 234 mounted on auxiliary framework 140 for effecting rotation of feed drive rolls 224 and 222.

Potentiometer 223 is connected to stabilizer drive motor 234 for controlling the speed of the motor depending upon movement of chain 212 and sprocket 216. Movement of the sprocket and chain in one direction will cause the potentiometer to effect a speeding up of the motor, while movement of the sprocket and chain in an opposite direction will cause the potentiometer to effect a slowing down of the motor.

Since dancer roll 202 is capable of vertical sliding movement, it is able to react to changes in the tension on the tape to mitigate against tape breakage.

The feed drive rolls feed the tape past a pair of horizontally-spaced guide rolls 236 and 238, see FIG. 1A, supported upwardly of wall 90 of printing module 14 and wall 20 of tape supply and take-up module 12 respectively to roll 46. The tape passes from roll 46 to first dancer subassembly 54 and to take-up reels 26.

INDUCTION GENERATOR AND CONTROL MODULE 18

The induction generator and control module is a compact self contained commercially available unit sold under the trademark LEPEL manufactured by Lepel High Frequency Labs, Inc., Long Island, N.Y. and utilizing an SCR control circuit manufactured by Firing Circuits, Inc., Norwalk, Conn., which houses its own water recirculator system as well as a solid state firing circuit which takes care of the ramp up and ramp down heat control with individual adjustments for each ramp. The on signal and off signal as well as the maximum output signal come from the stabilizer motor 234 thereof. The ramp speed can be advanced or retarded from line speed to suit drying so that the system does not over shoot line speed.

GEAR DRIVE SYSTEMS

Printing module 14 includes a fixed gear drive system which operates through double universal drive means which allow the individual rolls to move in and out at random while the gear system remains in a fixed position.

Figure 11:
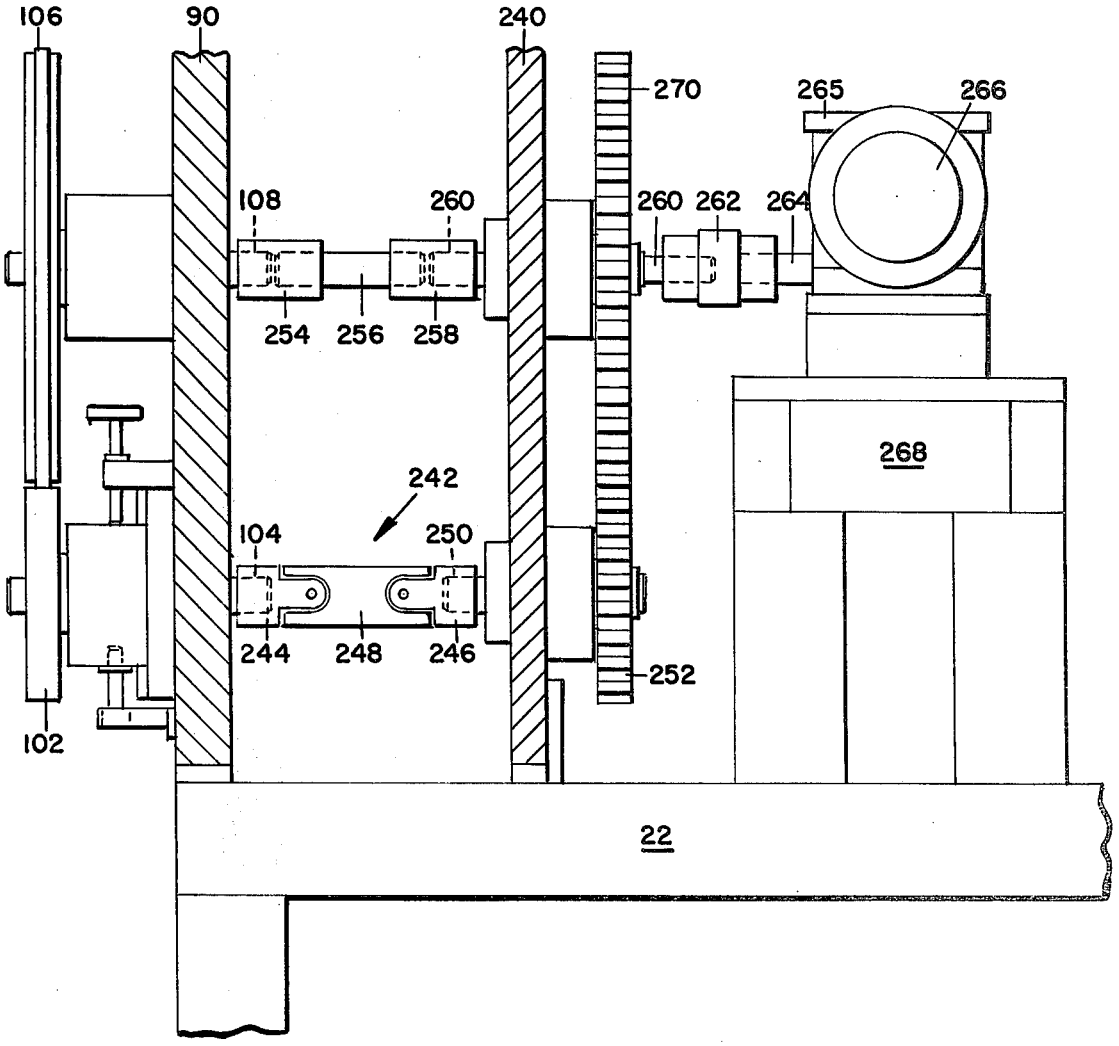
FIG. 11 is an enlarged cross-sectional view taken on line 11—11 of FIG. 1A, with parts omitted.
Figure 19:
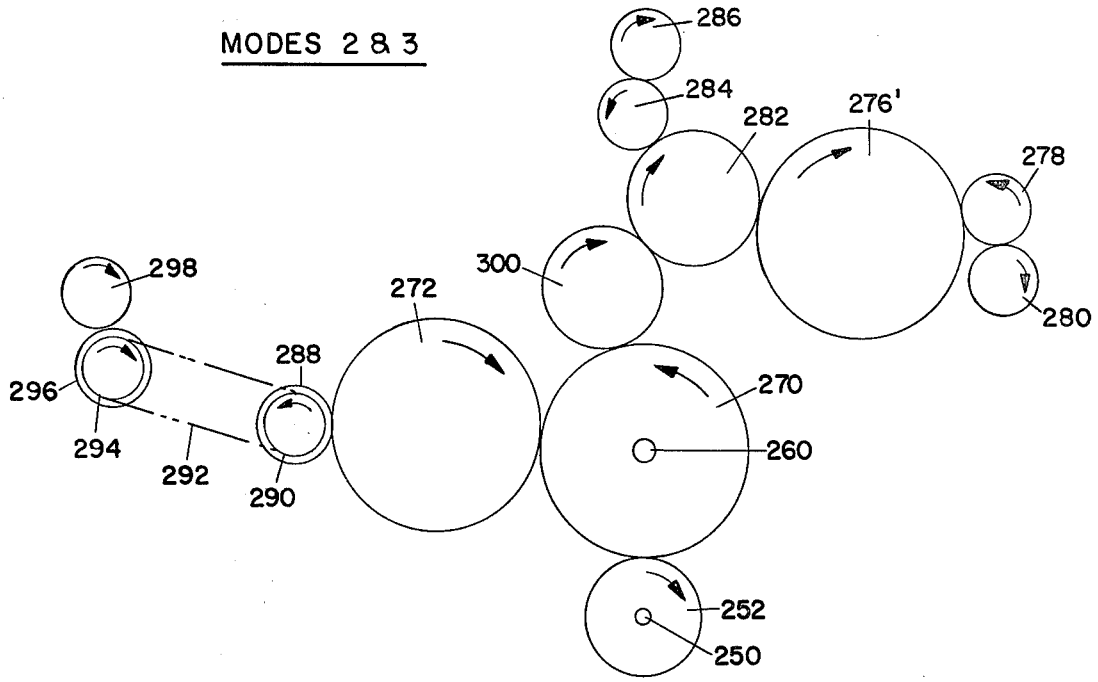
FIGS. 19 and 20 are schematic showings of two modes of gearing arrangements.
Figure 20:
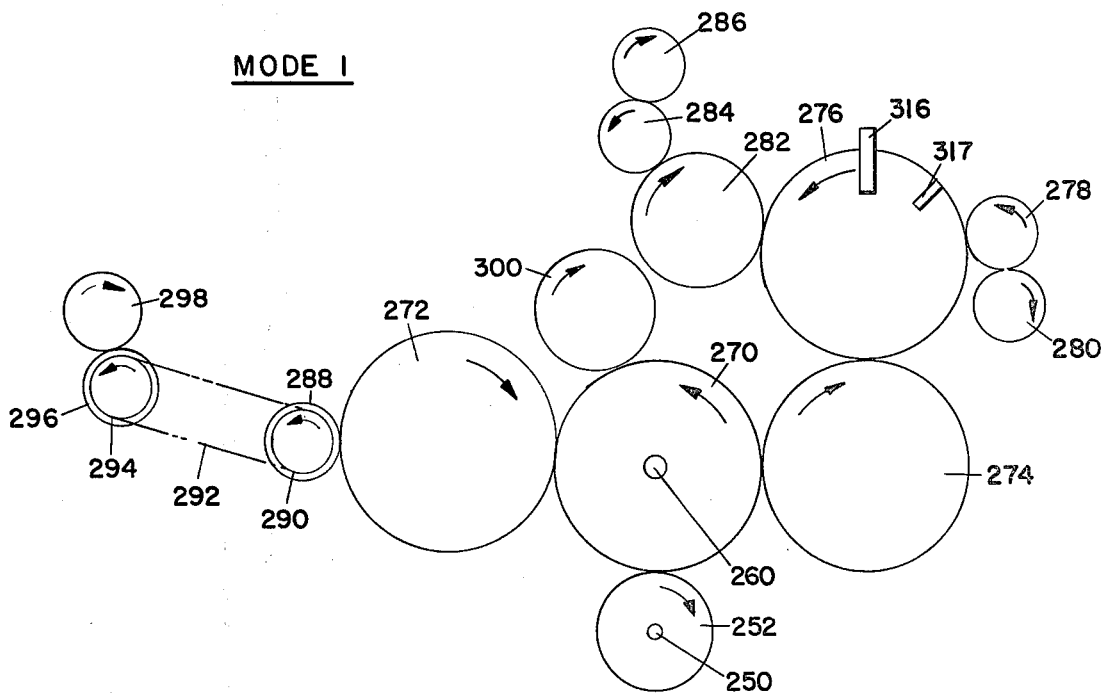

Two modes of gearing are shown schematically in FIGS. 19 and 20, while the double universal drive means is shown in FIG. 11.

As seen in FIG. 11, an upright, bearing wall 240 is disposed in spaced parallelism to and rearwardly of wall 90 of printing module 14 and extends upwardly from supporting framework 22.

As shown, double universal drive means 242 extends horizontally between walls 90 and 240 and comprises first and second end portions 244 and 246 respectively, each pivotally connected to an intermediate portion 248 in the usual manner of universal couplings.

The rearward end of shaft 104 of pressure roll 102 is fixed in first end portion 244 of universal drive means 242 and the forward end of a stub shaft 250 is fixed in second end portion 246 thereof. Stub shaft 250 is journalled in and extends horizontally through wall 240 and has a pressure roll gear 252 fixed thereto rearwardly of wall 240.

Similar double universal drive means are provided for all rolls with the exception of bull roll 106. As shown in FIG. 11, bull roll shaft 108 is fixed in one end of a first coupling 254, the other end of which carries one end of a first connector shaft 256. The other end of first connector shaft 256 is fixed in one end of a second coupling 258 the other end of which carries one end of a second connector shaft 260 which is journalled in and extends horizontally through wall 240. The other end of second connector shaft 260 is fixed in one end of a third coupling 262, the other end of which carries the end of a shaft 264 which extends outwardly from a reduction gear unit 265 mounted on a platform 268 provided on supporting framework 22 rearwardly of bearing wall 240. Reduction gear unit 265 is linked to a printer drive motor 266 also mounted on platform 268 rearwardly of wall 240.

A bull roll gear 270 is fixed to second connector shaft 260 rearwardly of bearing wall 240 and meshes with pressure roll gear 252 of pressure roll 102.

In the first mode of machine operation, as shown in FIG. 20, bull roll gear 270 additionally meshes with a pin roll gear 272 and a blanket roll gear 274, linked to the pin roll 122 and the blanket roll 112 respectively and journalled in bearing wall 240.

Blanket roll gear 274 meshes with a master die roll gear 276 journalled in bearing wall 240 and linked to master die roll 116. Master die roll gear 276 drives a pair of meshing first color inker gears 278 and 280 journalled in bearing wall 240 and linked to the rolls of first color inker 120.

Master die roll gear 276 additionally meshes with a spur gear 282 journalled in bearing wall 240 and which drives a pair of meshing second color inker gears 284 and 286 also journalled in bearing wall 240 and linked to the rolls of second color inker 156.

Pin roll gear 272 meshes with a drive gear 288 journalled in bearing wall 240 and which carries a sprocket 290 on its shaft. A chain 292 is entrained around sprocket 290 and around a sprocket 294 fixed to the shaft of an idler gear 296 also journalled in bearing wall 240 and which meshes with a supplemental second color inker gear 298 linked to one of the rolls of supplemental second color inker 174 and journalled in bearing wall 240.

As aforesaid, each of the several above-itemized gears, with the exception of gear 270, is linked to its respective roll by double universal drive means, not shown, similar to double universal drive means 242 and which extends between walls 90 and 240.

In the second and third modes of machine operation, as shown in FIG. 19, blanket roll gear 274 is omitted to render blanket roll 112 inoperative and drive to a pin roll gear 276' journalled in bearing wall 240 and linked to pin roll 116' is effected by an idler gear 300 also journalled in bearing wall 240 which meshes with both bull roll gear 270 and with spur gear 282.

It will be observed that, in the first mode of machine operation, as seen in FIG. 20, gear 300 has been moved out of engagement with gear 282 wherefore it effects no driving action.

FEED ROLL DRIVE

Figure 12:
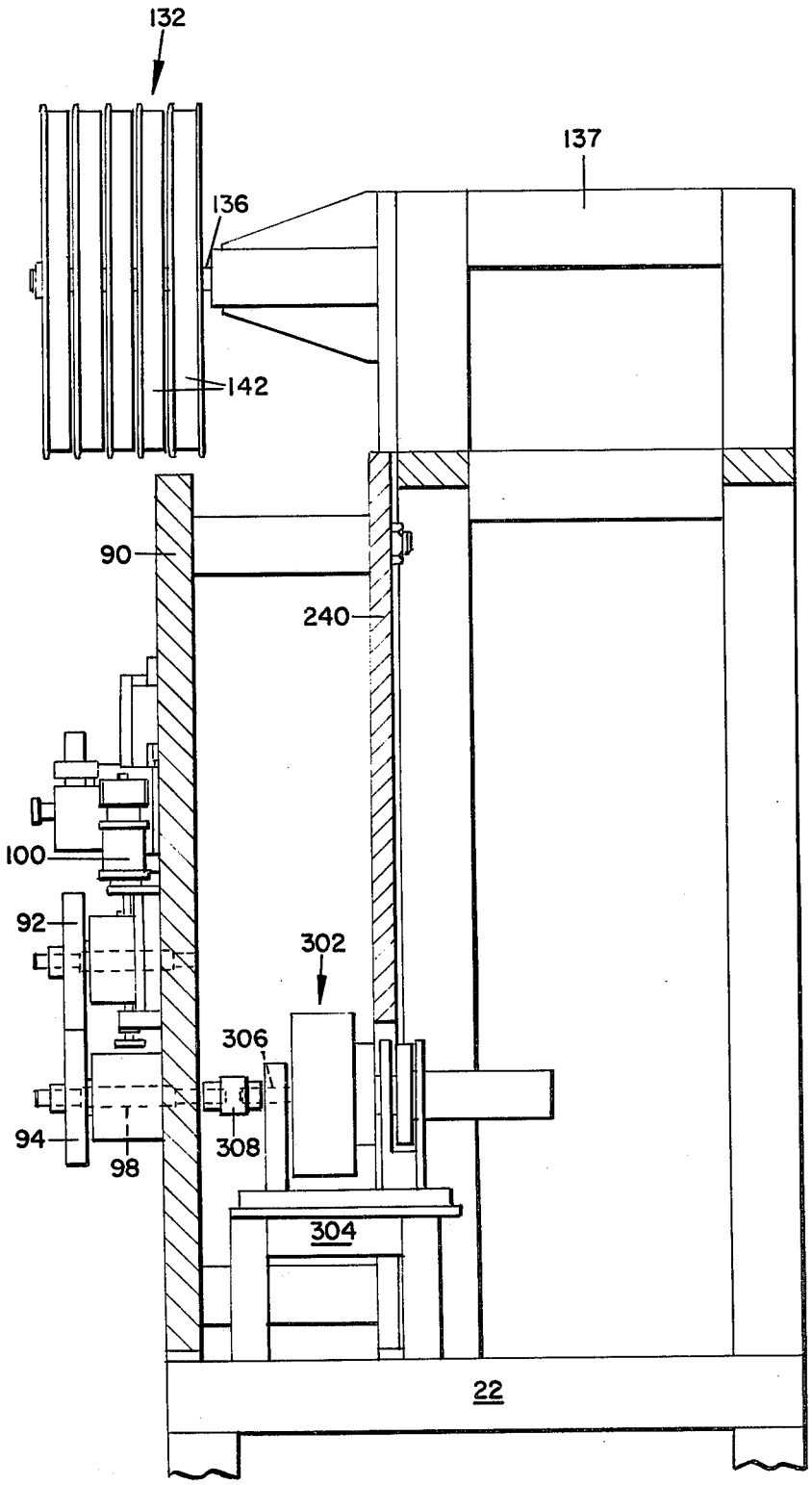
FIG. 12 is an enlarged cross-sectional view taken on line 12—12 of FIG. 1A, with parts omitted.

As best seen in FIG. 12, feed or metering roll 94 is driven by a drum-type hysteresus metering means 302 supported on a platform 304 provided on supporting framework 22 rearwardly of wall 90, with the drive shaft 306 of the hysteresus metering means being linked to shaft 98 of metering roll 94 by a coupling 308.

Hysteresus metering means 302 is a slip clutch of commercially available type linked to solid state logic control unit 88. It is a clutch on shaft 306 for restraining rotation of that shaft and rotation of feed or metering roll shaft 98 linked thereto. It is controlled by varying the voltage fed thereto (i.e. the less voltage, the less restraint on shaft 306 for easier rotation of the shaft, the more voltage, the more restraint on shaft 306, for more difficult rotation of the shaft).

SCANNERS

For printing long English tapes in the first mode of machine operation, solid state logic control unit 88 receives its information from a pair of scanners 312 and 314 which are placed at a distance of 6" around the outside diameter of the bull roll 106 and a sync scanner 316 mounted on the rear face of bearing wall 240 so as to overlie die roll gear 276, the sync scanner being so positioned as to pick up a white timing mark 317 on the rear face of die roll gear 276. All of the scanners are of commercially available photoreflective type.

When running short tapes, the scanners are not utilized.

Figure 5:
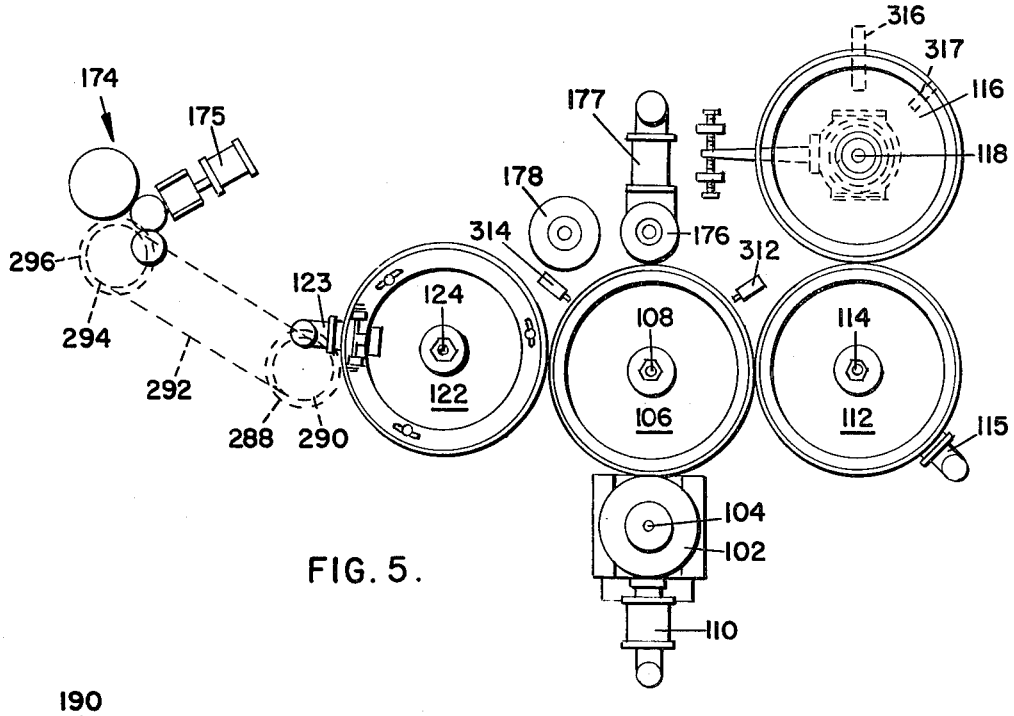
FIG. 5 is an enlarged, front elevational view of the roll arrangement in one mode of machine operation.
Figure 6:
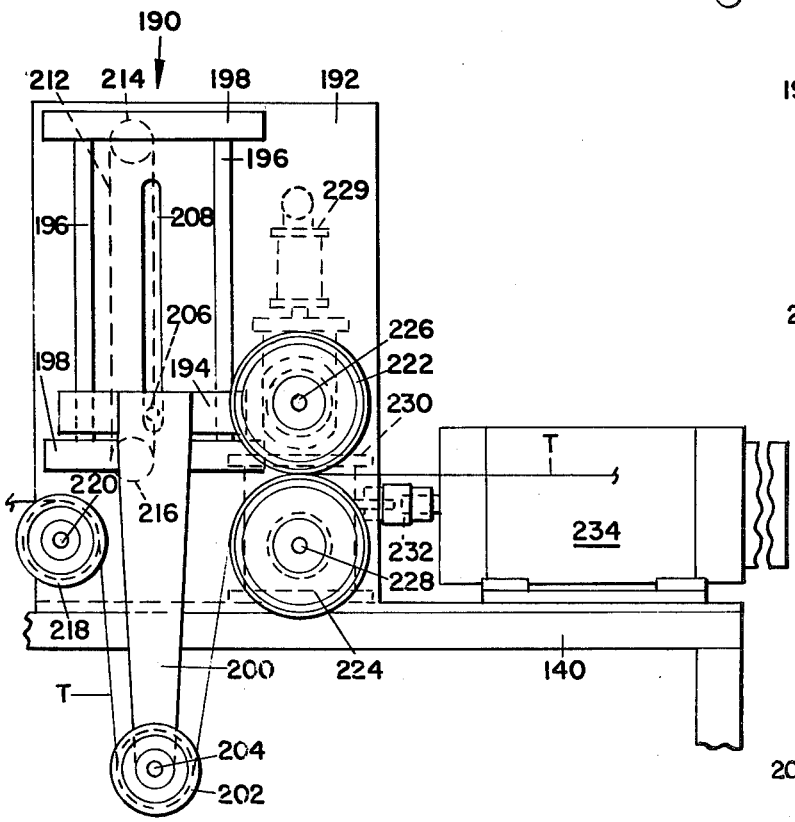
FIG. 6 is an enlarged, fragmentary, front elevational view of the second dancer subassembly.
Figure 7:
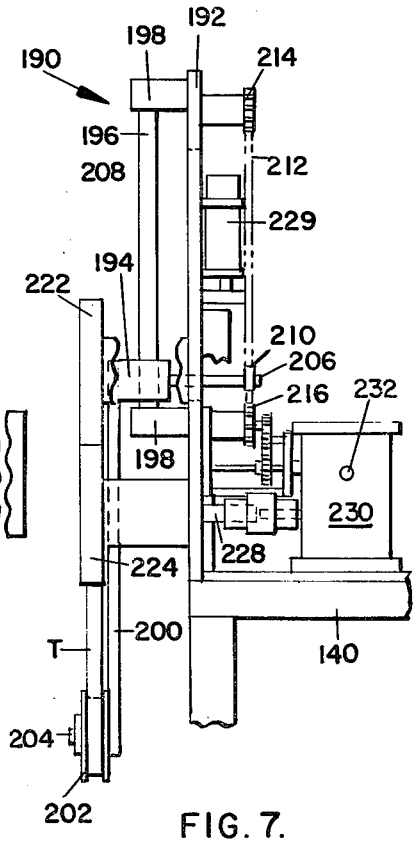
FIG. 7 is a side elevational view of the second dancer subassembly of FIG. 6 with the motor omitted.

As best seen in FIG. 5, the pair of scanners 312 and 314 are placed on the arc about bull roll 106. They feed information to the logic control unit 88 which in turn interprets the information and makes a correction by applying more or less voltage to the hysteresus metering unit 302, (scanner 312 before scanner 314 = short = less voltage, and scanner 314 before scanner 312 = long = more voltage.) The scanners 312 and 314 read every ½" mark at every 1" interval. The scanners are turned on when the system reaches line speed and the sync scanner 316 is in line. The scanners 312 and 314 are reset every revolution (4') by sync scanner 316. The sync scanner also corrects for any electronic drift.

The gap from one ½" line to the other ½" line is obtained via a pulse stretcher which is fired by each scanner, the pulse stretcher blocking out all other lines and numbers.

Figure 21:
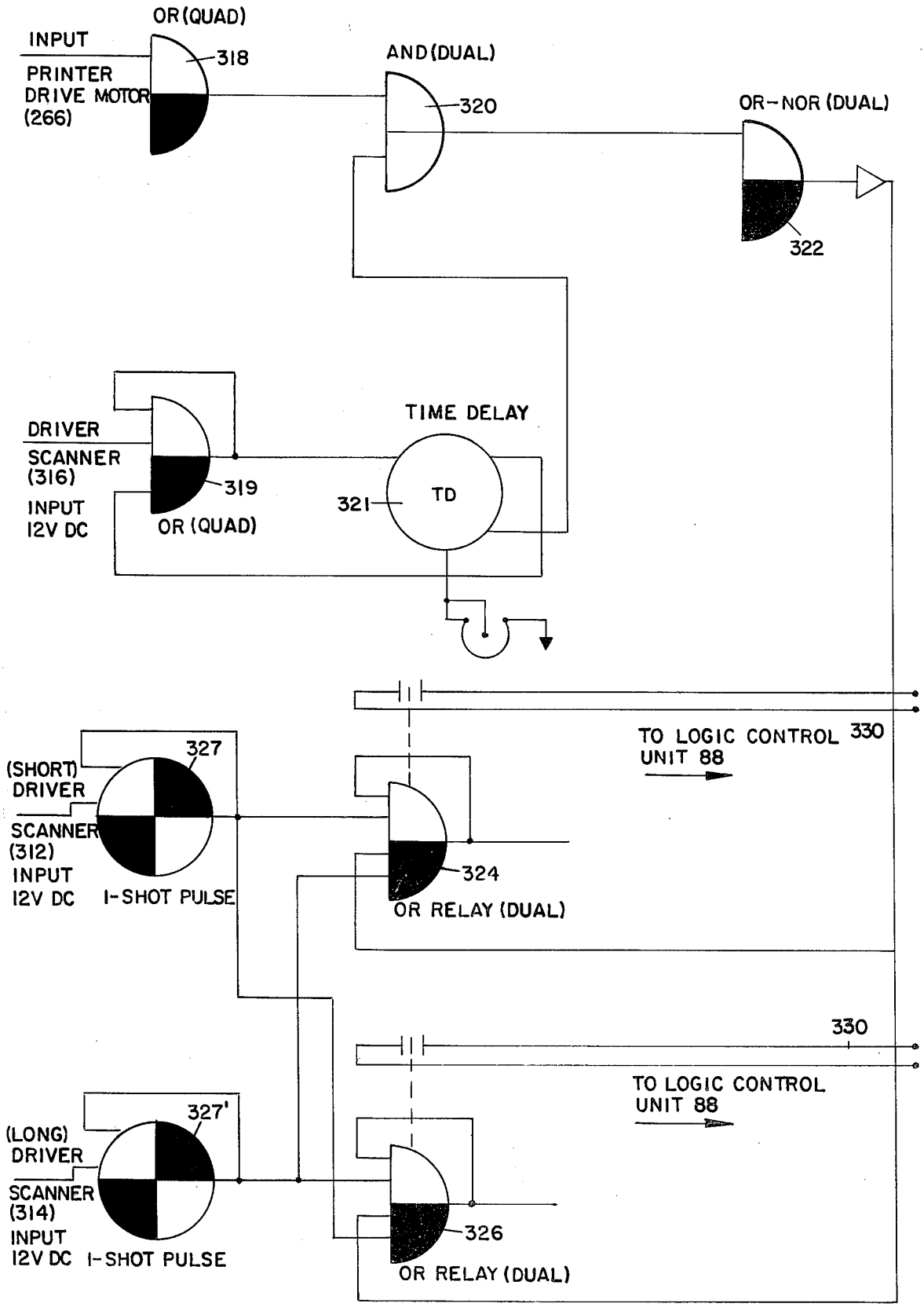
FIG. 21 is a schematic representation of the scanner electronic control circuit.

The electronic control circuit for the scanners is shown in FIG. 21, the components of this circuit being located in operator's control panel 84 and being linked to logic control unit 88.

When the A.C. start button is depressed, the control circuit is energized, including the optics scanners 316, 312 and 314 along with logic control circuit 88. The drives are at rest or zero speed. At this time a dual OR-NOR 322 has a 12V DC output which feeds the inhibit sides of a pair of dual OR relays 324 and 326, thereby preventing an output from them. When the line start button is depressed drive clutches of each of take-up reel drive motor 34, printer motor 266 and stabilizer motor 234, (see FIGS. 23–25), are energized by contact. As the line accelerates to line speed the following events occur:

1. Scanner 316 detects timing mark 317 on die roll gear 276 and energizes a quad OR 319.
2. Quad OR 319 output energizes a time delay 321 which is set to be maintained in an ON condition for 356.25°.
3. Output from time delay 321 is one input required to energize a dual AND 320. The delay off each revolution is 3.75°.
4. As the printer reaches the set line speed a signal from the printer motor 266 will have sufficient output to energize a quad OR 318.
5. The output from time delay 321 and that of quad OR 318 now satisfy the dual AND 320 2 input requirement for 12V DC output.
6. The dual AND 320 output changes the state of the dual OR-NOR 322 output from +12V DC to zero.
7. With the output of dual OR-NOR 322 at zero the dual OR relays 324 and 326 will now have outputs depending on which scanner receives the first signal, as each scanner output has an inhibiting function which will prevent the other from signalling an output.
8. A 1-shot pulse 327 or 327' limits each scanner output to an output from each ½" mark every 1". This permits gating out unwanted signals in between.
9. The logic system is reset every revolution by virtue of scanner 316 which is keyed in with a ½" mark every revolution.

Figure 22:
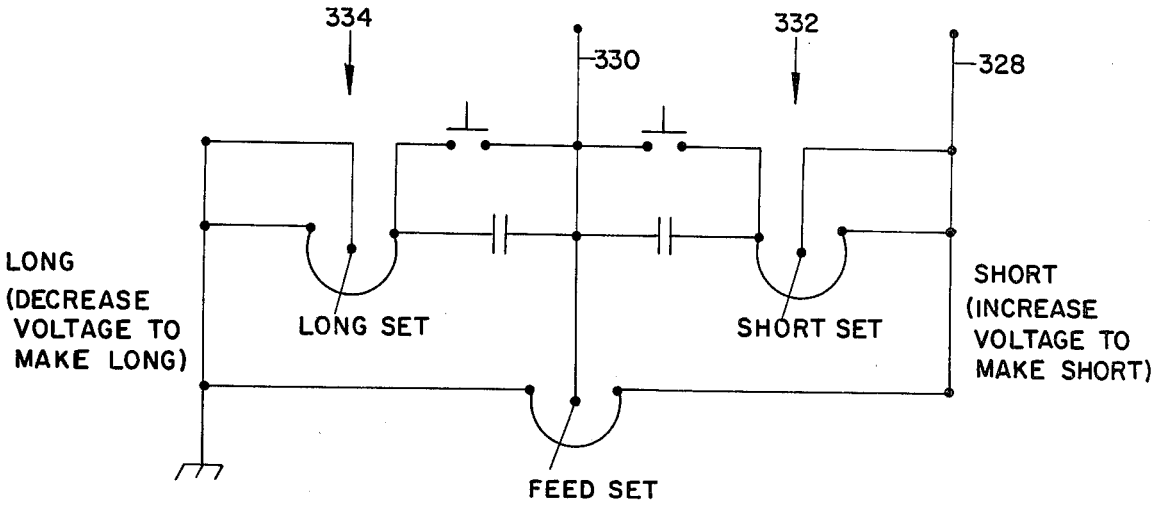
FIG. 22 is a schematic representation of the voltage control circuit.

The outputs from scanner OR relays 324 and 326 are contact closures which connect by lines 328 and 330 with bias potentiometers 332 and 334 respectively, (see FIG. 22), in logic control unit 88, to either increase or decrease the voltage of the set point of the unit. This output then controls the voltage fed to hysteresus metering unit 302 which is directly coupled to the shaft 94 of feed or metering roll 94, as aforesaid.

THE LOGIC CONTROL UNIT 88

The logic control unit 88 is a high threshold system which is a 12 volt system that minimizes the chance for any outside interference. The logic control unit 88 houses the aforementioned bias potentiometers which are shown schematically in FIG. 22.

THE DRIVE MOTORS

Figure 23:
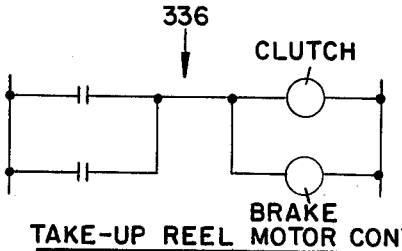
FIGS. 23–25 are schematic representations of the controls for the take-up reel motor, the printer motor and the stabilizer motor, respectively.
Figure 24:
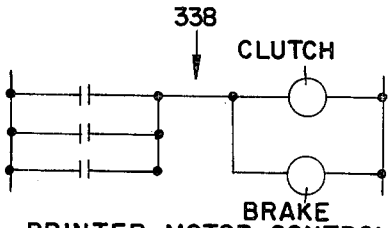
Figure 25:
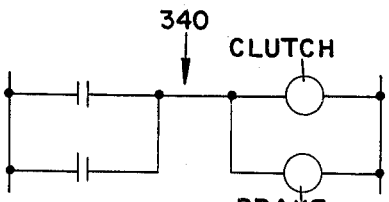

Each of the drive motors, i.e. take-up reel drive motor 34, printer drive motor 266, and stabilizer drive motor 234 has its own clutch and brake and supplies a voltage to its own controller circuit board located in main electrical control panel module 10, as follows: a take-up reel drive motor circuit board 336; a printer drive motor circuit board 338; and a stabilizer drive motor circuit board 340. Schematic showings of these circuit boards are shown in FIGS. 23, 24 and 25, respectively.

Each controller analyzes the data supplied and if the voltage varies up or down from its preset point (or line speed), a correction in that voltage is made to increase or decrease the speed of the particular drive motor which is varying.

Each drive motor has a clutch and brake so that acceleration and deceleration are smooth.

Figure 26:
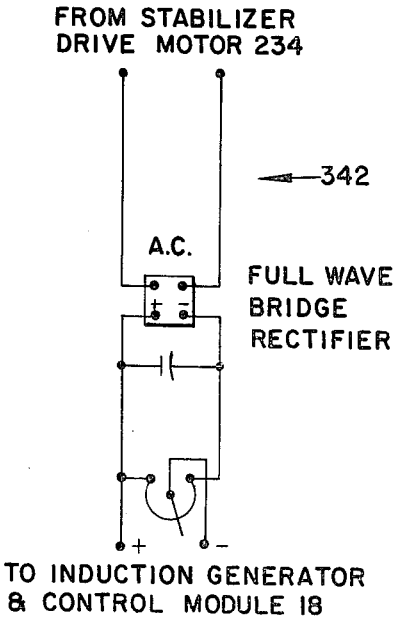
FIG. 26 is a schematic showing of the rectifier unit between the stabilizer drive motor and the induction generator and control module.

The stabilizer drive motor 234 also serves as a signalling device for the firing circuit of induction generator and control module 18. The signal from the stabilizer drive motor is a low level signal (0–5 volts). The firing circuit converts the low level signal to a high level signal (0–440 volts). This output is then fed to the induction generator. The rectifier 342 between stabilizer drive motor 234 and induction generator and control module 18 is shown schematically in FIG. 26.

MACHINE PNEUMATICS

Figure 28:
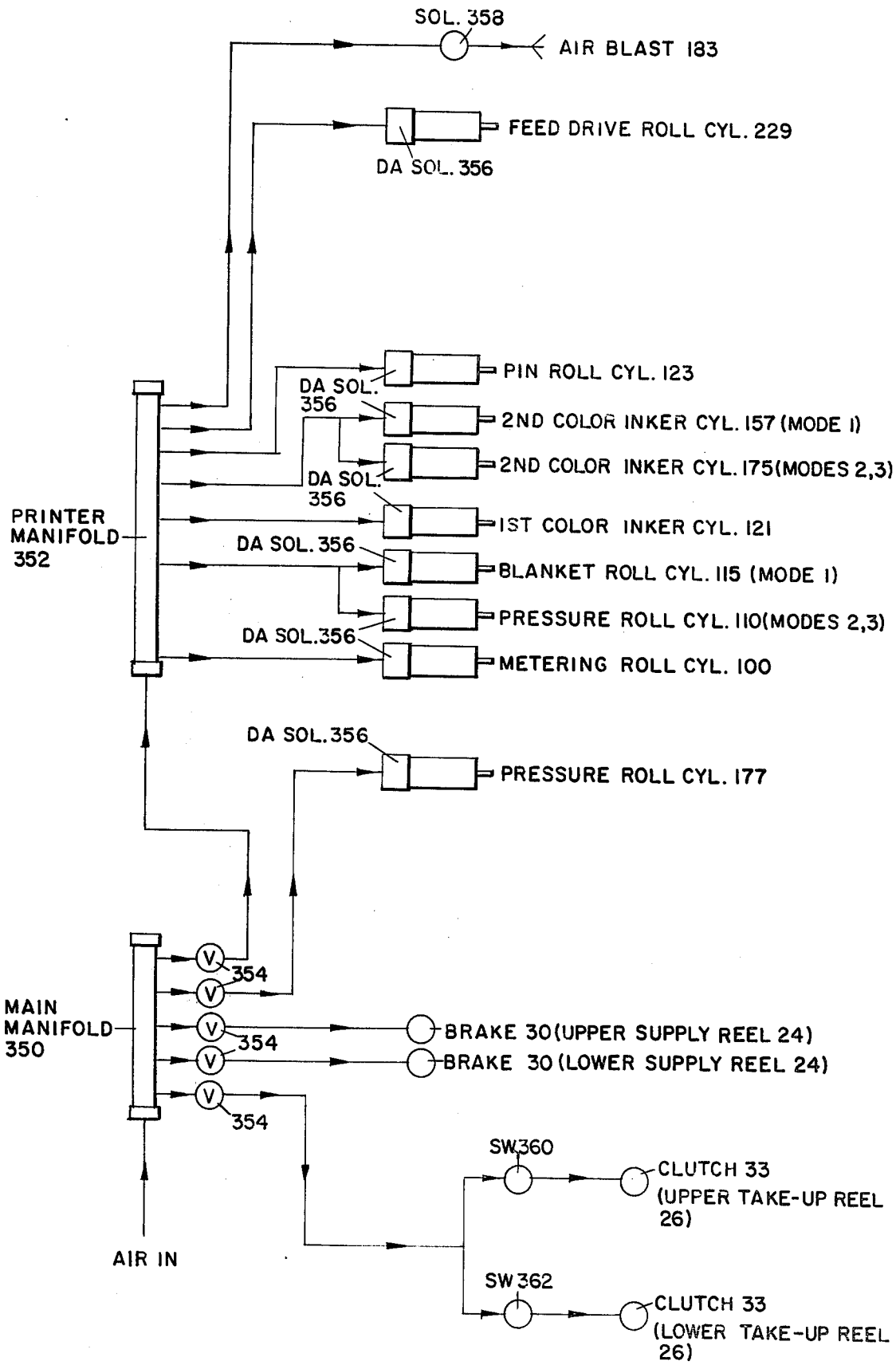
FIG. 28 is a schematic showing of the machine pneumatic components.

The machine pneumatic circuit is shown schematically in FIG. 28.

Air is fed through a main manifold 350 and a printer manifold 352 to the various components as shown, with regulator valves 354, double acting solenoids 356 and a solenoid 358 being provided for control purposes. Individual switches 360 and 362 are provided for the upper and lower take up reel clutches 33.

Figure 27:
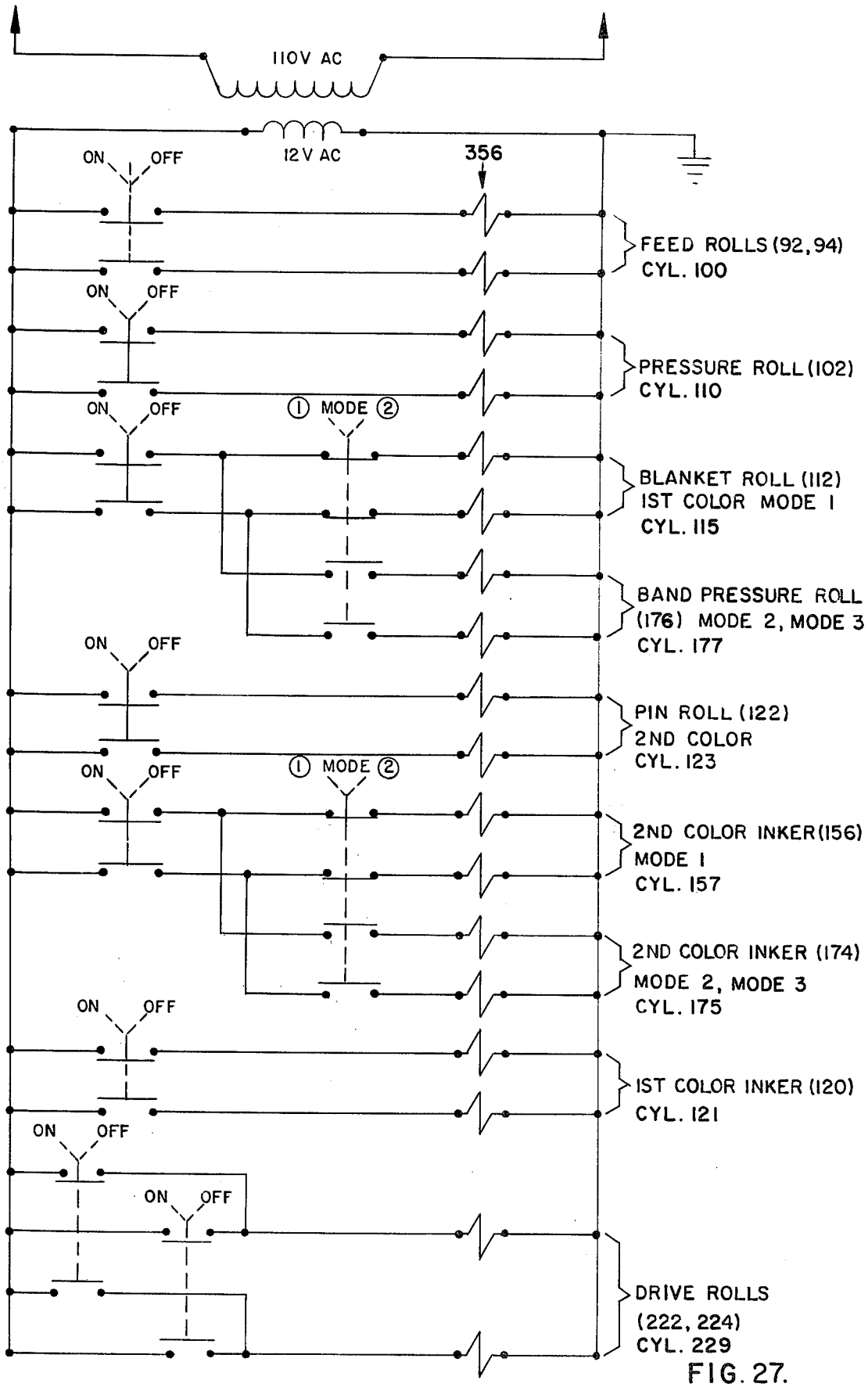
FIG. 27 is a schematic showing of the electrical circuitry for controlling certain of the machine pneumatic components.

The electrical circuit for controlling the pneumatic circuit (with the exception of the brakes 30 and clutches 33, which are not electrically controlled), is shown in FIG. 27.

IN GENERAL

The machine is modular and offers a completely self-contained unit.

All controls and pneumatics are easily accessible to the operator with on-off controls at both ends of the system as well as at the main control panel.

The complete system is set up to operate at 250 ft per min. with high accuracy and is capable of printing the following:

| | |
|---|---|
| 50 ft | 2 color via wheel and band |
| 100 ft | 2 color via wheel and band |
| Metric | 2 color via 2 bands |
| Short tapes | 2 color via 2 bands |

No split gears or anti-backlash gears are employed, wherefore all gearing can be precision cut. Special precision double universal drive means are used.

An engraved master print roll using offset printing via a blanket roll is used for printing long English tapes. For long and short metric and English tapes, a two-band system is used in lieu of the engraved master print roll.

Precision pin wheels are employed for carrying the color bands which have precision holes for positive drive, with the bands using a unique, individual multi-roll system for ease of driving the band while conserving space.

An electronic control system monitors the material as it is being printed and meters the flow of material through the machine.

A pneumatic pressure system gets printing within a certain range, then the electrical system takes over and monitors the tape being printed.

The machine prints at 250 ft. per minute with high accuracy and is controlled continually at line speed.

A compact machine and system is provided which only takes 35″ × 6″ × 10″ floor space for a complete 100 ft. printing machine and system.

We claim:

1. A machine for printing measuring tapes of various lengths comprising: a plurality of interconnected modules including a tape supply and take-up module having a tape supply portion and a tape take-up portion, a printing module, an induction generator and control module and a stabilizing module, the printing module including a bull roll and a first pin roll, first means cooperant with the bull roll and first pin roll for printing indicia of a first color on the face of a tape blank, second means cooperant with the bull roll and first pin roll for printing other indicia of a second color on the same face of the so printed tape blank, the stabilizing module including an induction heating coil, water spray nozzles and an air blast through which the printed tape passes, a take-up reel at the take-up portion of the tape supply and take-up module, a drive roll at the stabilizing module, separate drive means for the take-up reel, the drive roll and the bull roll, and separate control means for each drive means, dancer subassemblies at the tape take-up portion of the tape supply and take-up module and at the stabilizing module for maintaining the tape under constant tension, and a fixed gear drive system in the printing module linked to all rolls of the printing module, each roll of the printing module with the exception of the bull roll being linked to one of the gears of the fixed gear drive system by double universal drive means.

2. A machine according to claim 1, wherein the first means cooperant with the bull roll and first pin roll comprises a first printing band and a first pair of grooved roll assemblies.

3. A machine according to claim 1, wherein the second means cooperant with the bull roll and first pin roll is a second pin roll, a second printing band and a second pair of grooved roll assemblies.

* * * * *